United States Patent [19]

Lyons

[11] 4,434,862

[45] Mar. 6, 1984

[54] DOWNHOLE TURBINE ROTARY DRILLING DEVICE

[76] Inventor: William C. Lyons, P.O. Box 2457, Santa Fe, N. Mex. 87501

[21] Appl. No.: 270,584

[22] Filed: Jun. 4, 1981

[51] Int. Cl.[3] ..... E21B 4/02

[52] U.S. Cl. ..... 175/103; 175/71; 415/502

[58] Field of Search ..... 175/107, 71, 17; 415/502, 503

[56] References Cited

U.S. PATENT DOCUMENTS

| | | | |
|---|---|---|---|
| 1,790,460 | 1/1931 | Capelivschnicoff | 175/107 X |
| 2,783,971 | 3/1957 | Carle et al. | 175/107 X |
| 3,365,170 | 1/1968 | Whittle | 415/502 X |
| 3,754,835 | 8/1973 | Ivanov et al. | 175/107 |
| 3,899,033 | 8/1975 | Van Huisen | 175/69 X |
| 3,938,596 | 2/1976 | Ivanov et al. | 175/107 X |
| 4,211,291 | 7/1980 | Kellner | 175/107 X |

*Primary Examiner*—Ernest R. Purser
*Assistant Examiner*—Michael Starinsky
*Attorney, Agent, or Firm*—James E. Snead; Marcus L. Bates

[57] ABSTRACT

This invention relates to a downhole rotary drilling device. More particularly, it relates to a gas operated turbine motor designed to be located downhole adjacent a rotary drilling bit to impart rotational force to the drilling bit and thus accomplish subsurface drilling operations.

5 Claims, 9 Drawing Figures

DOWNHOLE TURBINE ROTARY DRILLING DEVICE

BACKGROUND

A considerable amount of work has been done by various individuals and companies relating to devices to impart downhole rotational force to rotary subsurface drilling operations. These devices have concentrated either upon liquid or mud motors actuated by the drilling fluid to provide the rotational force, or they have related to high speed turbine engines. The difficulties that have been encountered include inability to adequately seal the mud turbines to prevent damage to the turbine itself by reason of the mud particles, or difficulties in providing proper thrust bearings to allow the rotary drilling operation and at the same time not interfere with the rotational motion imparted to the drilling operation. Additionally, attempts have been made to design electrical motors located downhole. However, the difficulties in transmitting the electrical energy downhole has resulted in electric motor devices which are not economically feasible.

OBJECTS OF INVENTION

It is important, therefore, to provide a downhole turbine motor that will impart downhole rotational motion to a standard drilling bit to achieve the drilling operation without the necessity of turning the entire string of drill pipe from the surface to the bit.

Another important object of the present invention is to utilize gas turbine techniques for downhole drilling while at the same time providing cooling of the drilling bit, avoiding the contamination of the turbine motor itself and providing a high speed stabilizing force for the drilling operation.

Other objects of the current invention are accomplished by the device shown in the following specification with accompanying drawings wherein.

Figure 1:
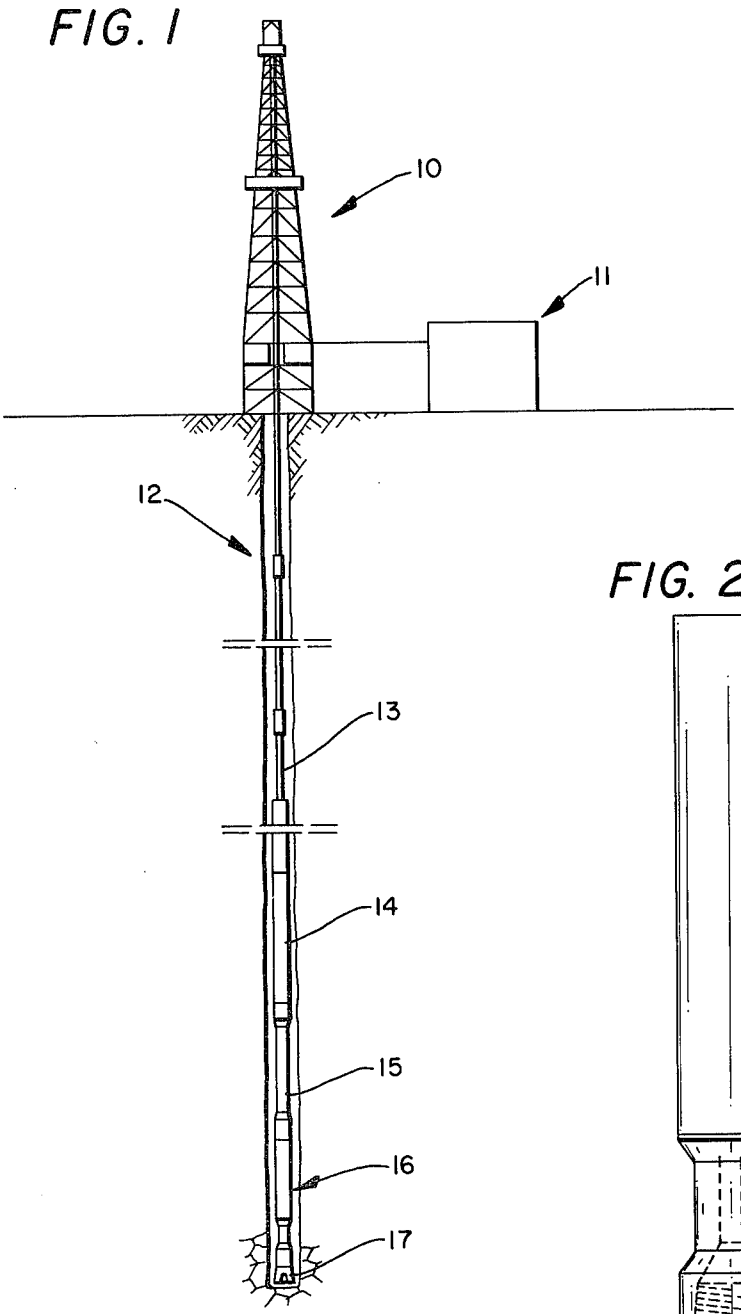
FIG. 1 is a schematic representation of the invention incorporated into a drilling operation.
Figure 2:
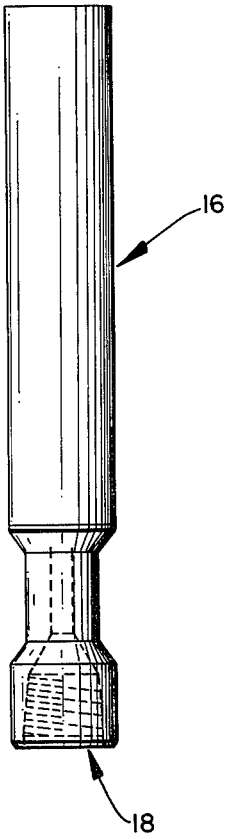
FIG. 2 is a view of the housing within which the gas turbine drilling device is enclosed, showing the downhole drilling bit sub.

Referring now to the drawings wherein like numbers indicate like parts, it will be seen from reference to FIG. 1 that in operation my invention is included within a drilling operation through a drilling rig 10 and it is interconnected into gas compression and injection system 11 through a drill string 12, including drill pipe 13, with drill collars 14 affixed in the normal manner to the downhole portion of the drill string 12. My oil reservoir and heat exchange collar 15 is attached to the downhole portion of drill collars 14, with my turbine engine 16 interposed between the oil reservoir and heat exchange collar 15 and the drill bit 17. The turbine engine housing 16 and bit sub 18 may be designed within a standard drill collar configuration as shown in FIG. 2, with a bit sub 18 attached downhole and adapted to receive a drill bit 17 and to rotatably engage turbine engine housing 16.

Figure 3:
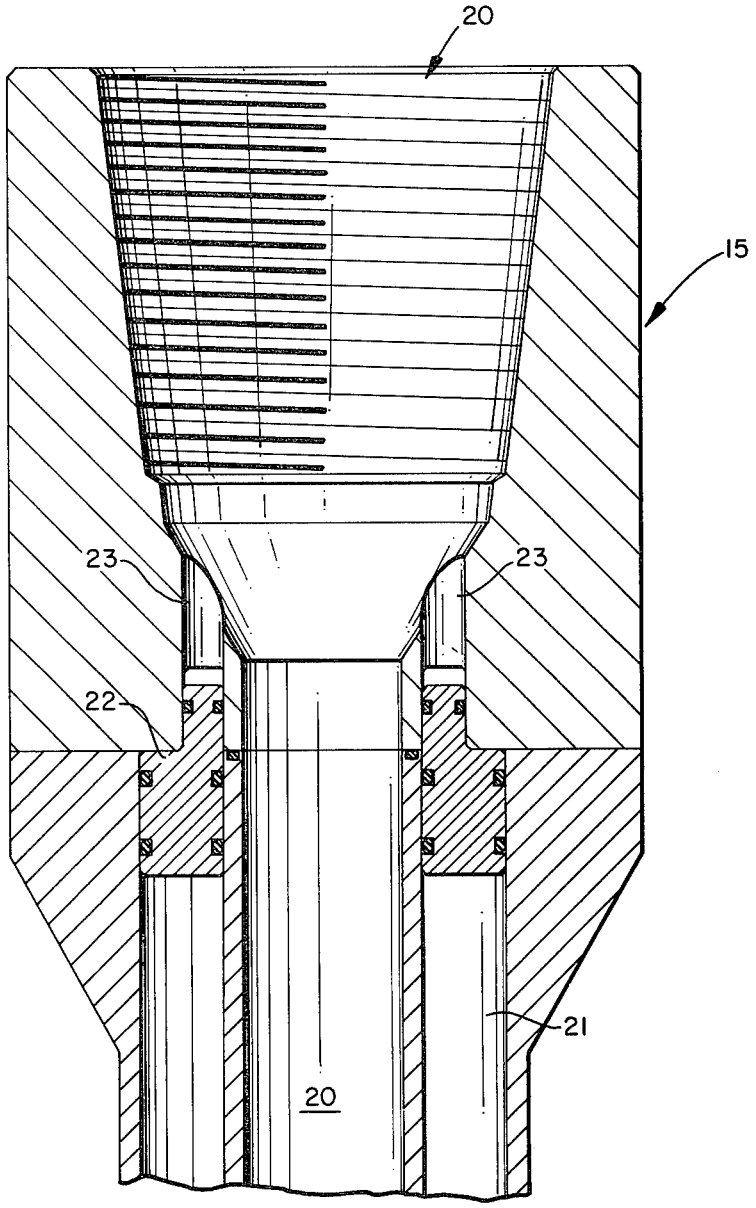
FIG. 3 is a partial cross-sectional view of the uppermost portion of the oil reservoir and heat exchanger portion of the invention.
Figure 4:
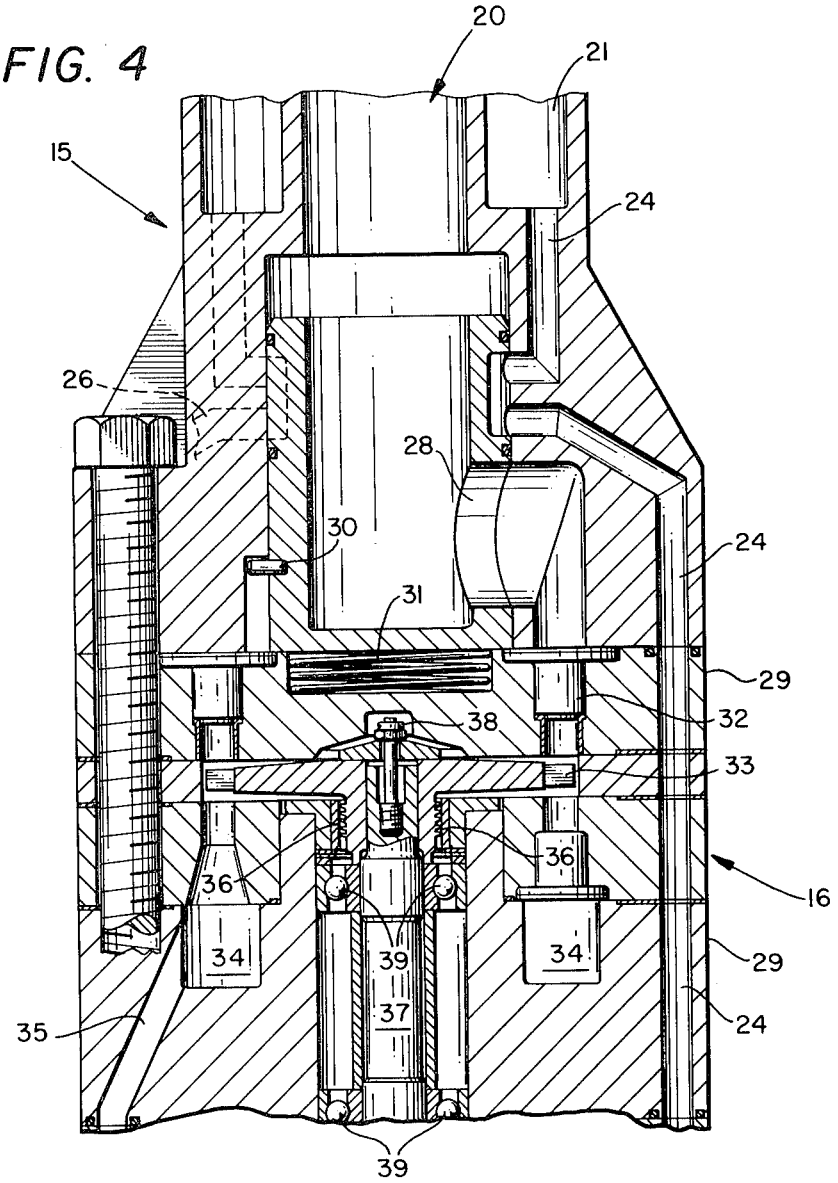
FIG. 4 is a partial cross-sectional view showing the lower portion of the oil reservoir and heat exchanger and its connection to the gas turbine engine.

Referring now to FIGS. 3 and 4, which are partial cross-sectional views of oil reservoir and heat exchange collar 15, it will be seen that these views show the internal workings of the oil reservoir and heat exchange collar 15, and its interconnection with the gas turbine engine 16. A gas passage 20 is provided through oil reservoir and heat exchange collar 15 so that gas injected into the drill string 12 from gas compression and injection system 11 flows through oil reservoir and heat exchange collar 15 into the turbine blades 33 in a manner to be hereinafter more particularly described. An oil reservoir 21 is provided within oil reservoir and heat exchange collar 15 to supply lubricating oil to the working parts of the gas turbine engine and reduction gearing system, and to further provide a heat exchange for the oil returned to reservoir 21 in a manner to be hereinafter more particularly described. A pressure piston 22 is housed within the uppermost portion of oil reservoir 21 and adapted to float on the lubricating oil in reservoir 21, in a sealed relationship to the internal walls of oil reservoir 21. Pressure passage ports 23 connect gas passage 20 into reservoir 21 above pressure piston 22 so that the gas injected into the drill string 12 and entering the turbine through gas passage 20 is diverted in part into pressure passage ports 23 so as to urge pressure piston 22 downward to pressurize on the lubricant within oil reservoir 21 and thus urge constant flow of lubricating oil to the working parts of the turbine and reduction gearing system when the system is in operation.

Figure 5:
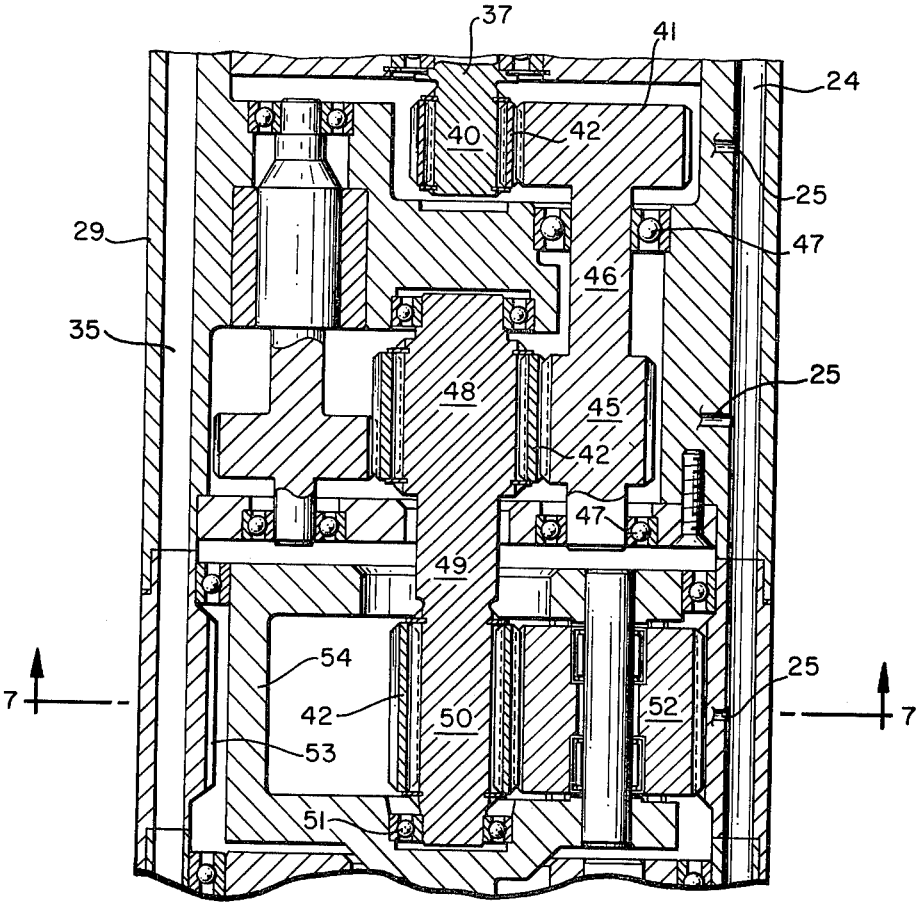
FIG. 5 is a partial cross-sectional view of the upper portion of the turbine engine which in operation is removeably connected to the lower portion of the oil reservoir and heat exchanger.

An oil supply line 24 is connected to the lowermost portion of oil reservoir 21 and thence through housing 29 of the gas turbine engine 16 to supply lubricating oil to the various working parts of the device. Oil drip ports 25 are spaced along oil supply line 24 at suitable locations as shown in FIG. 5, to drip lubricant into the working parts of the reduction gear system. An oil return line 26 provides means to return the oil to reservoir 21 for heat exchange and recirculation as shown in FIG. 4. The oil may be pumped through oil return line 26 into oil reservoir and heat exchanger 21 in the usual manner. Also shown in FIG. 4, is a pressure actuated control valve 28 urged into closed position by a compression spring 31 to block the oil supply line 24, return line 26 and gas passage 20 when the device is not in operation, and to be opened by gas pressure against compression spring 31 when the device is in operation. One of the purposes of the pressure actuated control valve 28 is to prevent debris from falling into oil supply line 24, oil return line 26 and gas passage 20 when the device is not in operation. An anti-rotation pin 30 prevents rotation of pressure actuated control valve 28 during operation of the device.

The compressed gas injected into the drill string 12 is injected through gas passage 20 and turbine inlet ports 32 to turbine blades 33 to actuate the turbine. An exhaust plenum 34 serves to route the exhaust gasses from the turbine blades 33 into exhaust passages 35 machined within turbine housing 29 all as is more particularly shown in FIG. 9. Turbine blades 33 are connected to turbine shaft 37 with a labyrinth seal 36 sealing shaft 37 against the passage of oil into the air passages of the turbine from oil supply line 24 and oil drip ports 25. Turbine blades 33 are connected to turbine shaft 37 by any standard fastener such as the nut and bolt arrangement shown at 38. Turbine shaft 37 is rotatably mounted within the turbine by shaft bearings 39. Turbine shaft 37 is fixedly connected to a first drive gear 40 in the reduction gear system of this invention.

In describing the reduction gearing system, it should be understood that any number of planetary and other reduction gear systems can be used with this invention depending upon the amount of reduction in revolutions per minute desired from the output of the turbine to the drill bit.

First drive gear 40 operably engages first follower gear 41 through a spline ring 42. It should be understood that throughout the reduction gearing system that is a part of this invention, the various drive and follower gears are operably connected through spline rings 42. First follower gear 41 is operably connected to second drive gear 45 through shaft 46 which shaft is rotatably housed within the turbine housing 29 by shaft bearings 47. Second drive gear 45 engages second follower gear 48 which in turn is connected through shaft 49 to third drive gear 50 rotatively mounted within the turbine by bearings 51. Third drive gear 50 engages planetary follower gears 52 in a manner more particularly shown by FIG. 7. Planetary follower gears 52 rotate and revolve within turbine housing 29, being actuated by third drive gear 50 and running within the housing on fixed gear 53. The planetary gear housing 54 provides a system by which the entire reduction system operates.

Figure 7:
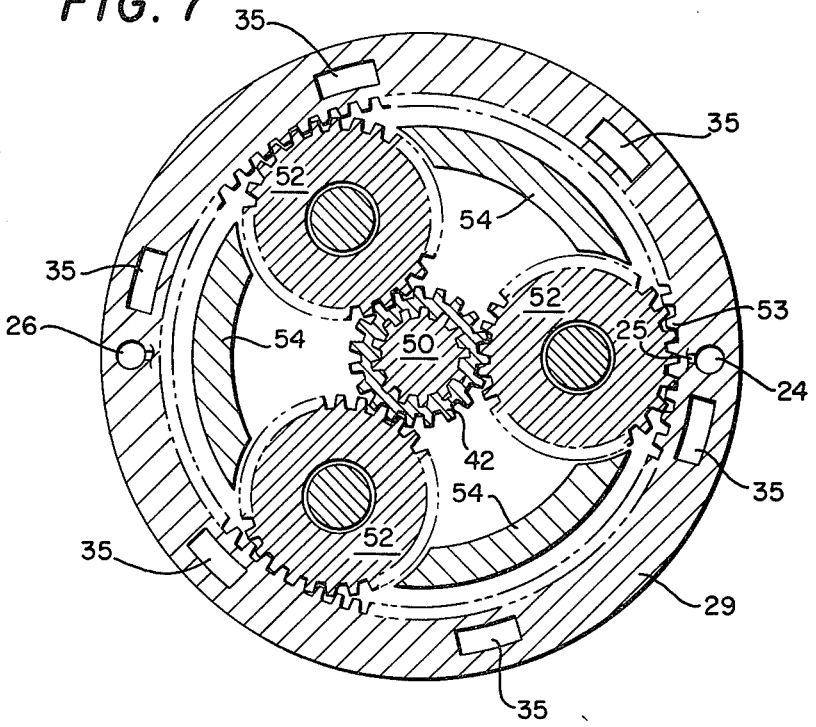
FIG. 7 is a cross-sectional view of a part of the gas turbine engine taken along lines 7—7 of FIG. 5, showing a cross-sectional view of one stage of the planetary gear reduction system, exhaust gas passages and oil supply and return lines, for the gas turbine engine.
Figure 8:
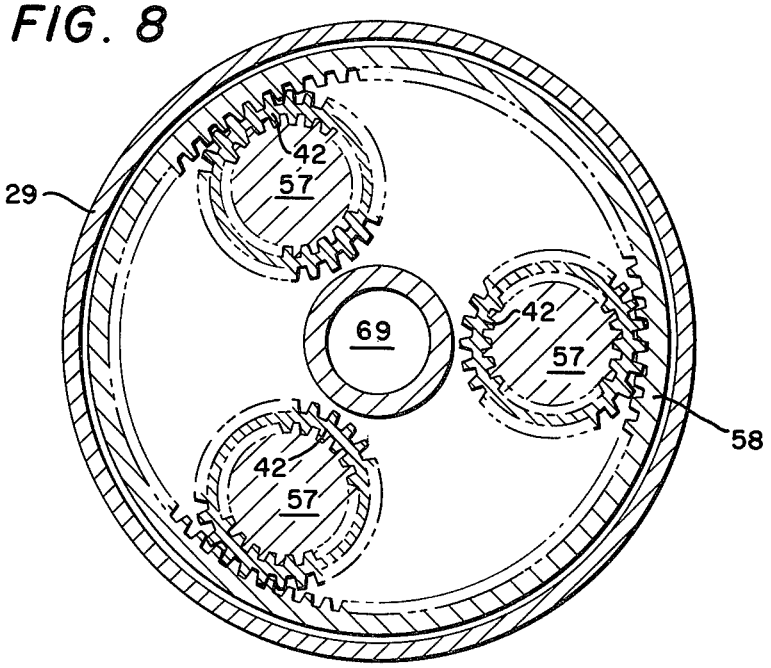
FIG. 8 is a cross-sectional view taken along lines 8—8 of FIG. 6, showing the final stage of the planetary reduction gearing system which comprises a part of this invention.

Cross-sectional views of a portion of the planetary reduction gear system are shown in FIGS. 7 and 8. The system is housed within the turbine engine housing 29 through which gas passages 20, oil supply line 24 and oil return line 26 are machined. Third drive gear 50 engages planetary follower gears 52 which in turn run on fixed gear 53 which is fixedly attached within turbine housing 20. Planetary follower gears 52 rotate within fixed gear 53 and thus engage planetary gear housing 54 to rotate reduction drive gear 55.

The entire reduction gear system can be repeated as many times as desired to achieve the optimum reduction in revolutions per minute for the system.

Figure 6:
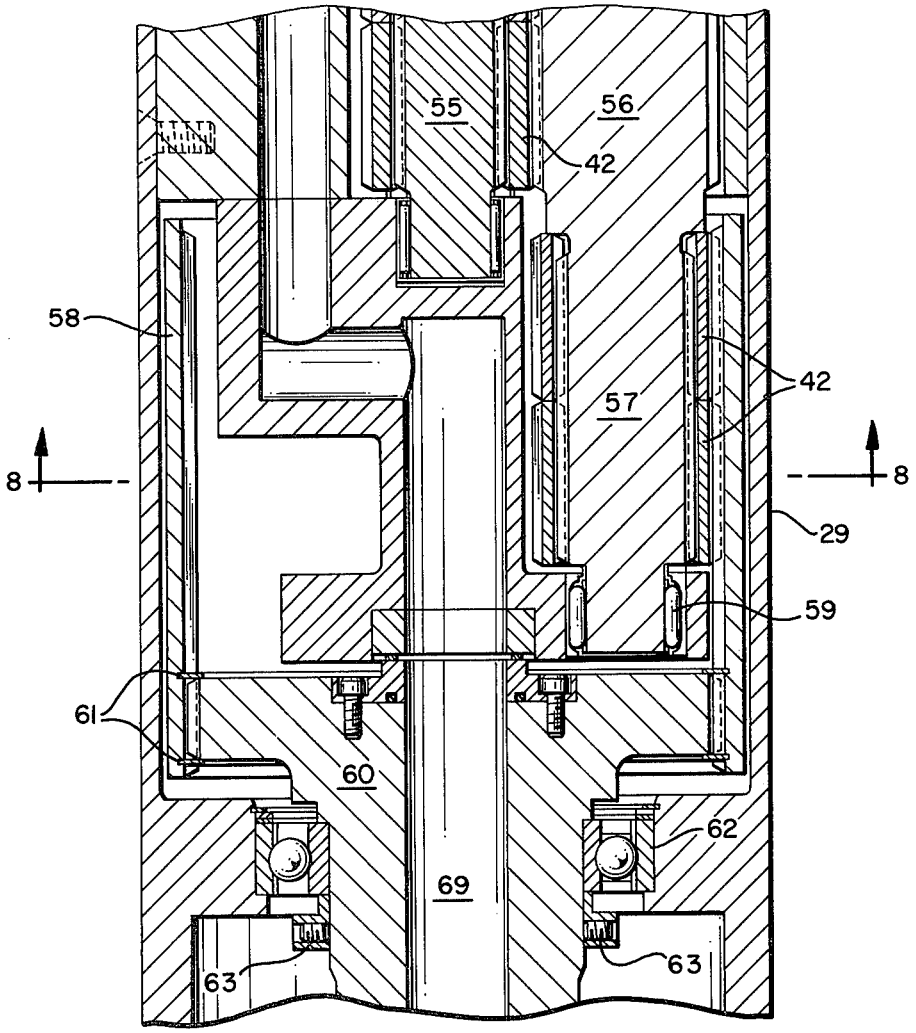
FIG. 6 is a still further partial cross-sectional view of a part of the gas turbine engine showing a part of the planetary gear reduction system that is a part of this invention.

As shown in FIG. 6 the connection of the output from the reduction gear system to the drill bit sub 18 is achieved through a reduction drive gear 55 which is connected through a spline ring 42 to follower gear 56 into final reduction drive gear 57. Final reduction drive gear 57 is connected through spline ring 42 to final reduction gear ring 58 rotatably mounted within housing 29. Bearings 59 rotatably support final reduction drive gear 57. A locking ring 61 connects final reduction gear ring 58 to drive shaft 60 which is rotatably mounted within the housing by radial bearings 62. Locking ring 63 secures shaft bearing 62 and prevents longitudinal movement of shaft 60.

Figure 9:
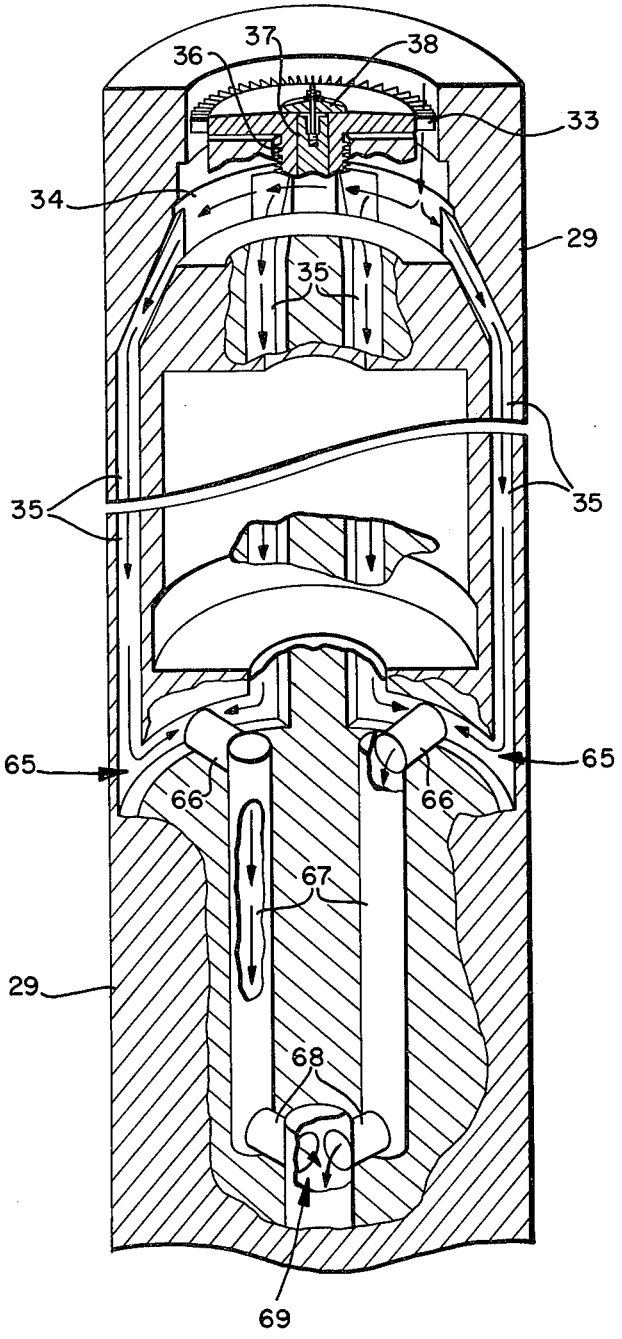
FIG. 9 is an isometric drawing showing the gas turbine housing in cut away to reveal the exhaust passage system which is a part of this invention.

The manner in which the gas which provides the actuating force for the system is connected through the system is more particularly shown in FIG. 9 which is a partial cutaway isometric view of the turbine housing with the turbine itself removed and the air passages which are machined into the housing being shown.

Referring now to FIG. 9, it will be seen that gas passage 20 is connected through turbine inlet ports 32 and turbine blades 33 into turbine exhaust plenum 34 and thence into exhaust passages 35 machined within turbine housing 29. First exhaust passages 35 bypass the planetary reduction gearing system and provide a passage for the turbine exhaust into a collection plenum 65 which collects the turbine exhaust gasses and passes them through first exhaust passage connectors 66 into second exhaust passages 67. Second exhaust passage connectors 68 connect second exhaust passages 67 into final exhaust passage 69. The turbine exhaust gasses are thus routed around the planetary reduction gearing system to exhaust from bit sub 18 and thence through a drill bit 17.

The exhaust gasses may be used not only for removal of cuttings, but also for cooling of drill bit 17. The manner in which this device is designed routes the turbine exhaust gasses through bit sub 18 into contact with the cones of a standard drill bit. In this manner the exhaust gasses provide a cooling medium for the drill bit. The temperature of the gas can be controlled and thus control the downhole temperature of the exhaust gas.

It will be seen from the foregoing that I have provided a gas actuated turbine drilling system that combines the high speed efficiency and stability of a turbine engine with a suitable reduction gearing system and lubricating system and avoids the sealing and other engineering problems encountered with a fluid or electricity actuated turbine engine.

What I claim is:

1. In a gas turbine drilling device for use in a borehole forming operation wherein means are provided for compressing and injecting gas into a drill string with drill collars attached to the downhole portion thereof, the improvement comprising:

a heat exchanger comprising an oil reservoir, said heat exchanger is housed in a collar and adapted to be removably attached to the downhole portion of the drill collars;

a gas turbine connected in underlying relationship respective to said heat exchanger;

a reduction gear means operably connected to the gas actuated turbine to thereby achieve a reduction in revolutions per minute between the output of the gas turbine and the final output of the gear reduction system, said gear reduction system being housed within a drill collar configuration and adapted to be attached to the output portion of the gas turbine;

a bit sub means removably attached to the output of said gear reduction system for operably connecting the output of said gear reduction system to a standard drill bit;

a gas passage means provided through said oil reservoir in said heat exchanger, said gas turbine engine, said gear reduction system, and said bit sub means to provide passage for gases through the system when all parts are operably connected together;

said oil reservoir in said heat exchanger contains lubricating oil and includes means for urging lubricating oil retained within said oil reservoir to flow to the working parts of the gas turbine engine and the reduction gearing system when the drilling system is operably connected;

means for returning the lubricating oil from the gas turbine and the reduction gearing system to the oil reservoir so as to provide continuous circulation of lubricating oil throughout the gas turbine and reduction gearing system; and valve means responsive to gas pressure for precluding flow of oil until the pressure at said gas passage means reaches a predetermined magnitude.

2. The device defined in claim 1, wherein;

the gas passage means includes turbine exhaust gas passages provided within the housing of the drilling device so as to route the exhaust gases around the reduction gearing system into the drill bit sub to exit through the drill bit and thereby provide cooling and cuttings removal for the drilling device.

3. The device as defined in claim 2, wherein:

said reduction gearing system includes a plurality of series connected planetary gears operably engaging the output shaft of said gas turbine in a manner so as to reduce the rotational speed of the output shaft of said gas turbine to a rotational speed which is suitable for a standard rotary drilling bit.

4. The apparatus as defined in claim 3, wherein;

the final planetary reduction gear system is connected to rotate the drill bit sub so as to connect the output of said gear reduction system to provide rotational force through the drill bit sub to a standard rotary bit.

5. The gas turbine drilling device of claim 1 wherein said oil reservoir is in the form of an annulus; an annular piston means reciprocatingly received in sealed relationship within said annulus and forming a variable said oil reservoir; and passageway means connecting the side of the piston which is opposed to the oil contained within said reservoir to the interior of said drill collar.

* * * * *